US011220883B1

(12) United States Patent
Kellam et al.

(10) Patent No.: US 11,220,883 B1
(45) **Date of Patent: *Jan. 11, 2022**

(54) RETRIEVABLE BACK PRESSURE VALVE AND METHOD OF USING SAME

(71) Applicants: Belo Kellam, Elk City, OK (US); Weldon Kennedy, Elk City, OK (US); Leslie Howell, Elk City, OK (US)

(72) Inventors: Belo Kellam, Elk City, OK (US); Weldon Kennedy, Elk City, OK (US); Leslie Howell, Elk City, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/819,384

(22) Filed: Mar. 16, 2020

Related U.S. Application Data

(63) Continuation of application No. 16/138,703, filed on Sep. 21, 2018, now Pat. No. 10,626,701, which is a continuation of application No. 15/833,109, filed on Dec. 6, 2017, now Pat. No. 10,113,391, which is a continuation of application No. 14/692,244, filed on Apr. 21, 2015, now Pat. No. 9,863,213, which is a continuation-in-part of application No. 14/670,802, filed on Mar. 27, 2015, now abandoned, which is a continuation of application No. 14/496,276, filed on Sep. 25, 2014, now abandoned, which is a continuation of application No. 14/246,232, filed on Apr. 7, 2014, now abandoned, which is a continuation of application No. 14/030,246, filed on Sep. 18, 2013, now abandoned.

(60) Provisional application No. 61/744,241, filed on Sep. 21, 2012.

(51) Int. Cl.
*E21B 34/06* (2006.01)
*E21B 34/10* (2006.01)

(52) U.S. Cl.
CPC ..... *E21B 34/06* (2013.01); *E21B 34/105* (2013.01); *E21B 2200/05* (2020.05)

(58) Field of Classification Search
CPC ..... E21B 34/06; E21B 34/105; E21B 2200/05
See application file for complete search history.

(56) References Cited

U.S. PATENT DOCUMENTS

| | | | |
|---|---|---|---|
| 6,808,023 | B2 | 10/2004 | Smith et al. |
| 9,091,148 | B2 | 7/2015 | Moffitt et al. |
| 9,920,583 | B2 | 3/2018 | Chruchill |
| 2009/0101345 | A1 | 4/2009 | Moffitt et al. |
| 2011/0203794 | A1 | 8/2011 | Moffitt et al. |
| 2015/0275620 | A1 | 10/2015 | Scott et al. |

*Primary Examiner* — Michael R Wills, III
(74) *Attorney, Agent, or Firm* — Phillips Murrah PC; Martin G. Ozinga

(57) ABSTRACT

The present invention is a retrievable back pressure valve device and method of using the same that may be placed in tubing during well completion and retrieved as desired by dropping a ball down hole, which then interacts with the valve to shear the positioning points allowing for retrieval as the valve is allowed to move up the well to be removed from same.

1 Claim, 11 Drawing Sheets

RETRIEVABLE BACK PRESSURE VALVE AND METHOD OF USING SAME

CROSS-REFERENCE TO RELATED APPLICATIONS

This is a continuation of U.S. patent application Ser. No. 16/138,703, filed Sep. 21, 2018, currently pending, which is a continuation of U.S. patent application Ser. No. 15/833,109, filed Dec. 6, 2017, now U.S. Pat. No. 10,113,391, issued Oct. 30, 2018, which is a continuation of U.S. patent application Ser. No. 14/692,244, filed Apr. 21, 2015, now U.S. Pat. No. 9,863,213, issued Jan. 9, 2018, which is a continuation-in-part of U.S. patent application Ser. No. 14/670,802, filed Mar. 27, 2015, now abandoned, which is a continuation of U.S. patent application Ser. No. 14/496,276, filed Sep. 25, 2014, now abandoned, which is a continuation of U.S. patent application Ser. No. 14/246,232, filed Apr. 7, 2014, now abandoned, which is a continuation of U.S. patent application Ser. No. 14/030,246, filed Sep. 18, 2013, now abandoned, which claims priority to U.S. Provisional Ser. No. 61/744,241, filed on Sep. 21, 2012. Each of the applications listed above is expressly incorporated herein by reference in their entirety.

BACKGROUND OF THE INVENTION

1. Field of the Invention

In general, the present invention relates to a retrievable back pressure valve device and method of using the same. More particularly, the present invention provides a pressure valve that can be positioned in the tubing during a horizontal well completion operations and can be removed after use by activating a shear system for disengaging the tool thus allowing for retrieval as desired without need of a wire-line unit. It is to be understood that the current invention may have other applications and is not limited to just use with horizontal well completion operations.

2. Description of the Prior Art

Horizontal wells have become the industry standard for unconventional and tight formation gas reservoirs. The objective of horizontal wells in tight formation and unconventional gas reservoirs is to improve the gas production rate, rate of recovery and project economics, just as in vertical wells. However, the completion and well stimulations in horizontal wells are far more complex. For many years, operators have utilized hydraulic fracturing to improve the performance of vertical, deviated and horizontal wells. Although often successful, these operators have more difficulty fracture stimulating deviated and horizontal wells than that which occurred during the stimulation of vertical wells in the area. Generally, the difficulties of fracture stimulating deviated and horizontal wells are evidenced by increased treating pressures and elevated post-fracture instantaneous shut-in pressures. In tight and unconventional gas reservoirs, greater operational control and reliability are necessary for operational success and to prevent erosion of project economics.

During the operation, plugs are generally used during the fracturing process that must be removed. These plugs are typically drilled out during the horizontal well completion operations. It is necessary to provide a back pressure valve in the well that can later be retrieved from the well when no longer necessary during this process. The prior art devices utilize running a wire down the well to physically attach and retrieve the back pressure valve. Needless to say due to the length of the well and the challenges of horizontal well operations, the placement and retrieval of these valves can be challenging, time consuming and costly.

It is therefore desirable to provide a back pressure valve that may be retrieved without the need of wire line unit, does not get stuck while being retrieved and may be retrieved from any position in the well bore. The above discussed limitations in the prior art is not exhaustive. The current invention provides an inexpensive, time saving, more reliable apparatus and method of using the same where the prior art fails.

SUMMARY OF THE INVENTION

In view of the foregoing disadvantages inherent in the known types of back pressure valve tools and methods of use now present in the prior art, the present invention provides a new and improved tool and method of use, which may be removably positioned in oil and gas wells to create back pressure and may be removed from the well easily and efficiently. As such, the general purpose of the present invention, which will be described subsequently in greater detail, is to provide a new and improved back pressure valve and method of using the same, which has all the advantages of the prior art devices and none of the disadvantages.

To attain this, the present invention essentially comprises a back pressure valve for use with horizontal well completion operations that provides for retrieval utilizing a shear system activated by dropping a ball down the well, which will seat in the valve creating a seal that can be pressurized to release the tool from the profile nipple. The invention allows for the string float to be run in a profile nipple and used to control well pressure from below.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a new and improved back pressure valve and method of using the same, which is of a durable and reliable construction and may be utilized at any depth and distance in a horizontal well completion operation.

It is a further object of the present invention to provide a new and improved back pressure valve, which may be easily and efficiently manufactured and marketed.

An even further object of the present invention is to provide a new and improved back pressure valve and method, which is susceptible to a low cost of manufacture with regard to both materials and labor, and which accordingly is then susceptible to low prices of sale to the consuming industry, thereby making such valve economically available to those in the field.

Still another object of the present invention is to provide a new and improved back pressure valve and method, which provides all of the advantages of the prior art, while simultaneously overcoming some of the disadvantages normally associated therewith.

Another object of the present invention is to provide a new and improved back pressure valve, which may utilize a shear release system that is activated by dropping a ball from the surface without the need for a wire-line unit.

Yet another object of the present invention is to provide a new and improved back pressure valve and method, which is designed to lock out once released so that it will not get stuck, reengage or otherwise hang up during the retrieval process.

An even further object of the present invention is to provide a new and improved back pressure valve and method that may installed in the tubing when the tubing is positioned in the well bore and may be retrieved from any position in the horizontal section of the well bore.

Still another object of the present invention is to provide a new and improved back pressure valve, which is designed to lock out once released, which provides safeguards from reengaging once shifted into a release position.

These, together with other objects of the invention, along with the various features of novelty, which characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there are illustrated preferred embodiments of the invention.

BRIEF DESCRIPTION OF THE PICTORIAL ILLUSTRATIONS, GRAPHS, DRAWINGS, AND APPENDICES

The invention will be better understood and objects other than those set forth above will become apparent when consideration is given to the following detailed description thereof. Such description makes reference to the annexed pictorial illustrations, graphs, drawings, and appendices wherein.

DETAILED DESCRIPTION OF THE PREFERRED EMBODIMENTS

Figure 1:
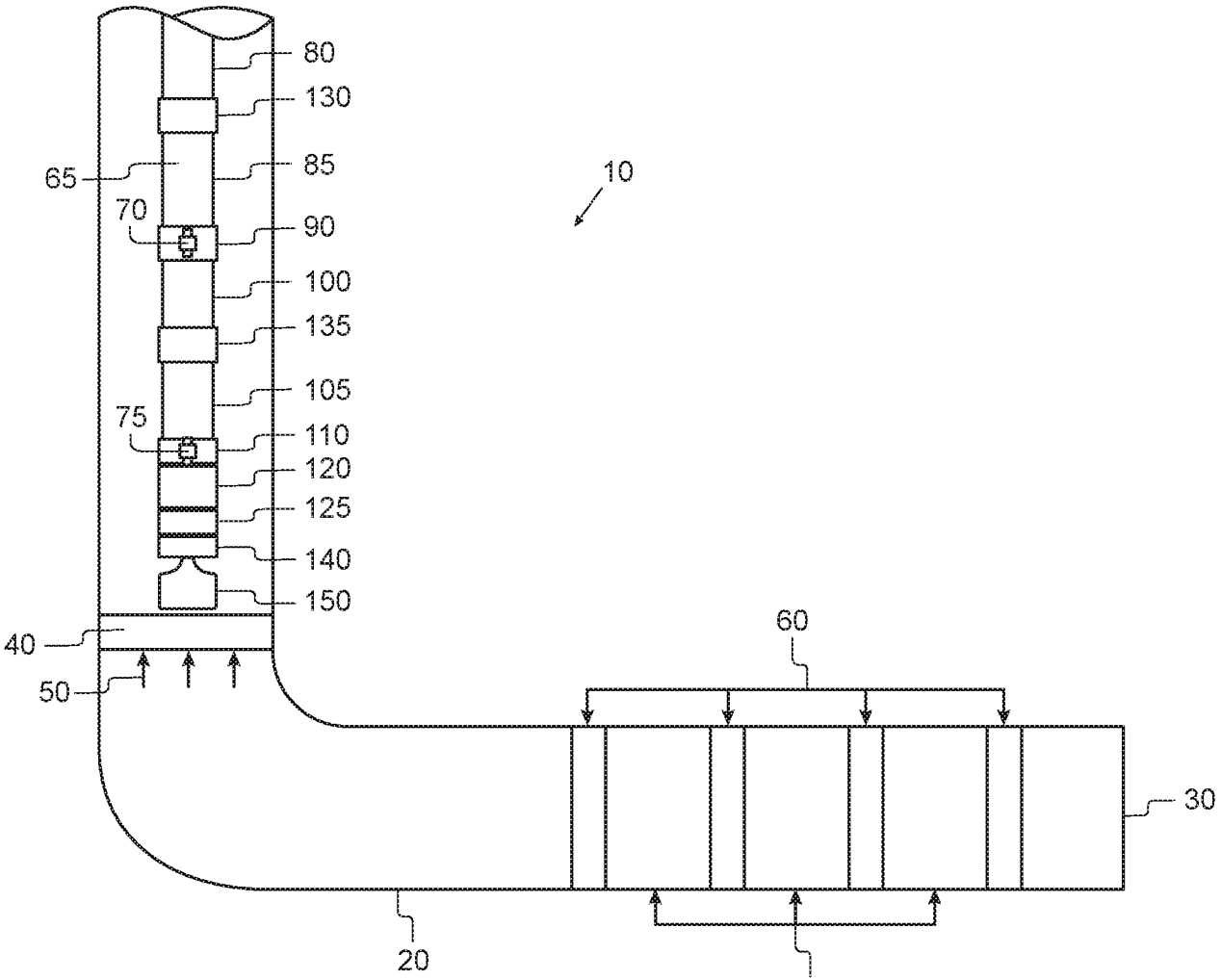
FIG. 1 is a general illustration in accordance with a preferred embodiment of the invention depicting the assembly being lowered down well to engage and drill out plug.

Referring to the illustrations, drawings, and pictures, reference character 10 generally designates a new and improved retrievable back pressure valve tool, system and method of using same constructed in accordance with the present invention. Invention 10 is generally used in a horizontal well 20 for the retrieval of hydrocarbons below the surface. It is contemplated that invention 10 may be utilized for other well applications other than hydrocarbon retrieval such as but not limited to water retrieval and also non-horizontal applications.

In Operation

Now referring to the illustrations in general and more in particular to FIG. 1, well 20 generally comprises a top at the surface and a bottom or end 30 where hydrocarbons enter well. It is understood that the current invention may be used on horizontal wells as generally depicted, but is not necessarily limited to such. As known in the prior art, during hydraulic fracturing, also referred to as frac, frack and or fracking, a control plug 40 is placed in well 20 to isolate pressure 50 from coming up well 20 and separate stage(s) 55 are formed by frac plug(s) 60.

The control plug 40 and the frac plug(s) 60 must be removed after the fracking procedure for well 20 productions. As also known in the prior art, the removal of these obstructions is accomplished by drilling them out, which essentially reduces them to small pieces that can then be removed by circulating mud out of the well 20. Assembly 65 is generally lowered into well 20 with one or more tools 70 as discussed further below when it is time for the drilling out of control plug 40 and or frac plug(s) 60. It is also understood that the weight of the assembly 65 and associated work string, pipe and or pipe string 80 above assembly 65 may be sufficient to prevent ejection due to the pressure 50 from under control plug 40 during the drilling out process and or the drilling out of frac plugs(s) 60.

Figure 2:
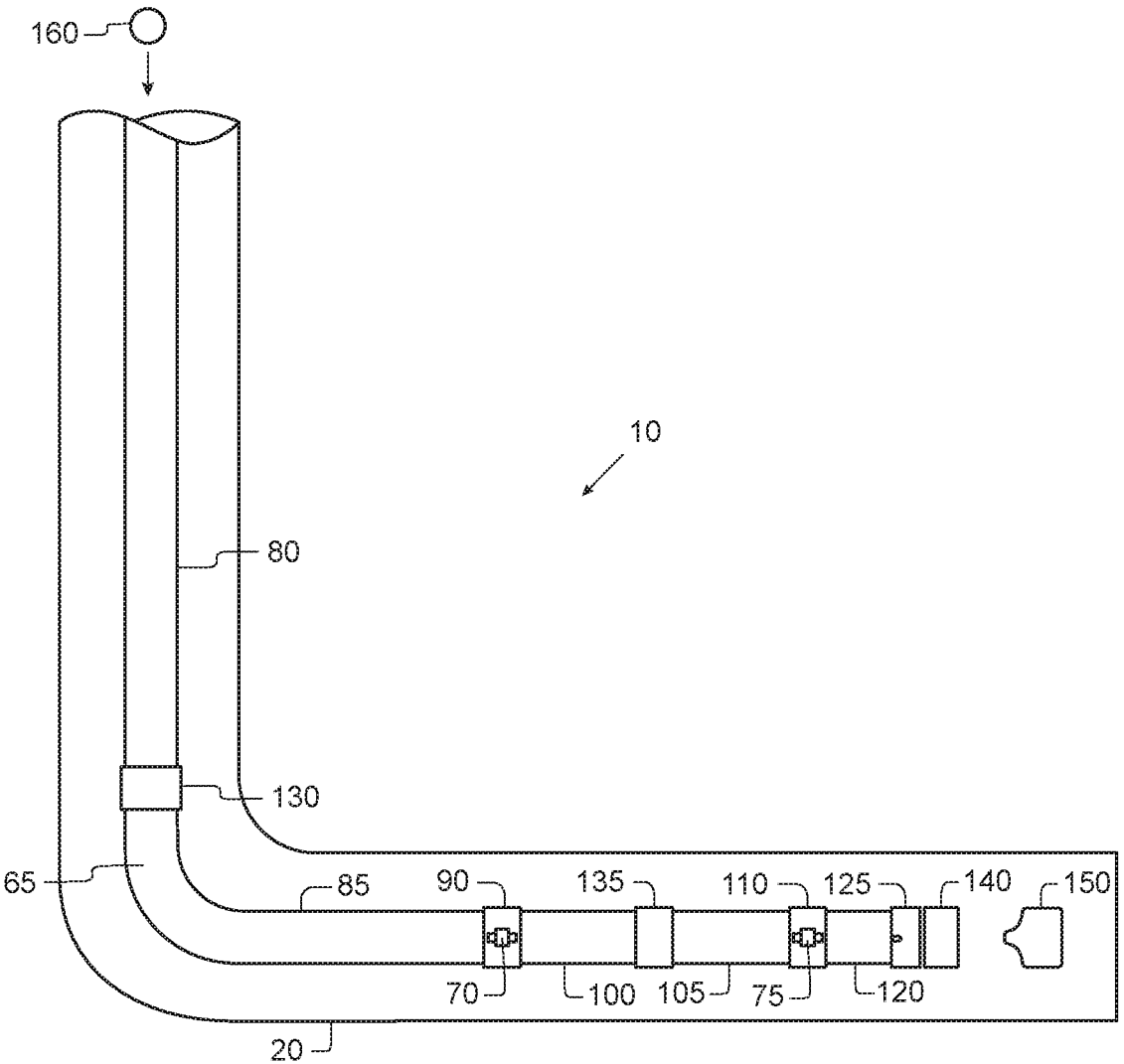
FIG. 2 is a general illustration in accordance with a preferred embedment of the invention showing the plugs drilled out and the drilling bit dropped off the assembly after a ball has been dropped from the surface to release the drill bit.
Figure 3:
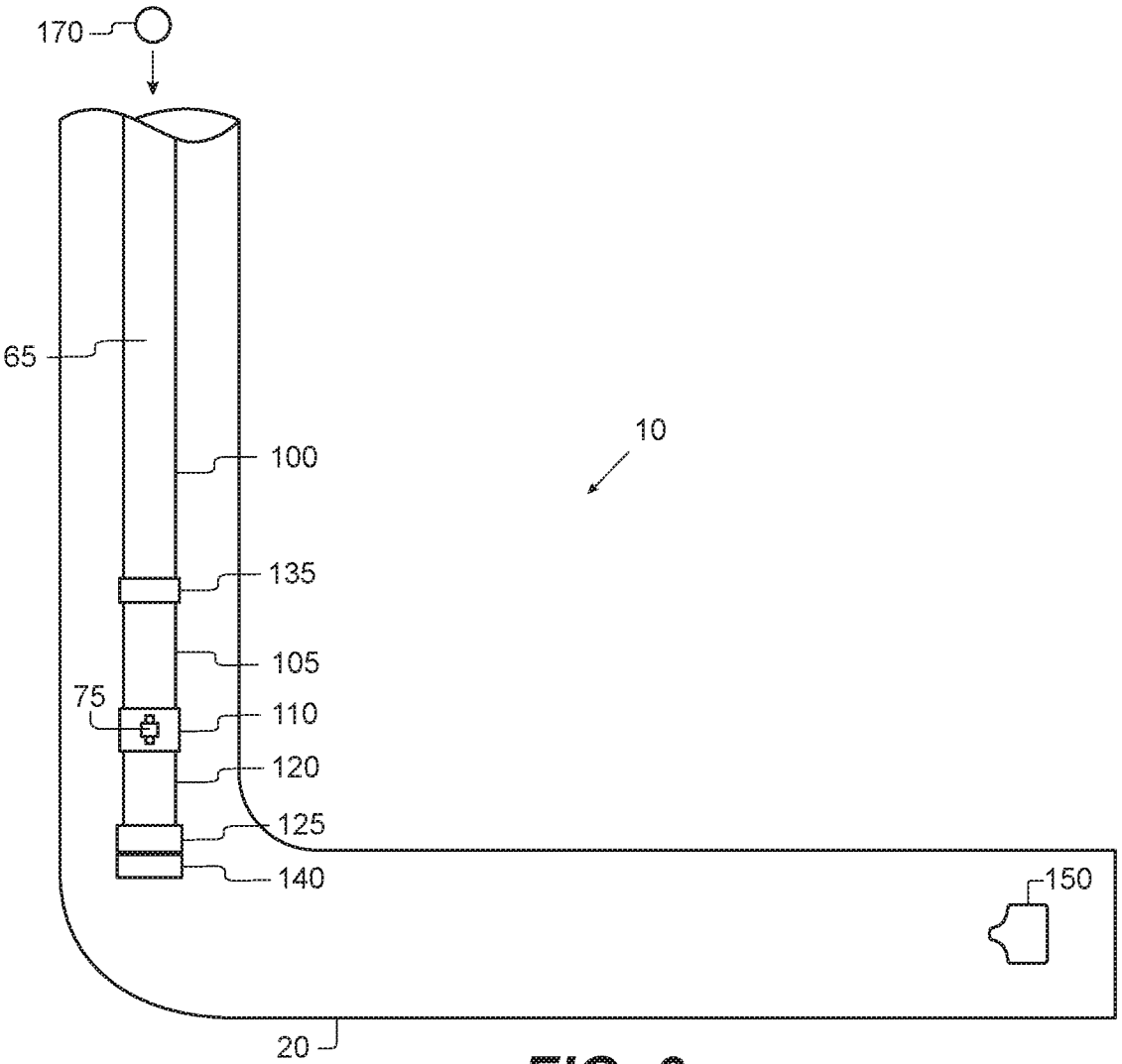
FIG. 3 is a general illustration in accordance with a preferred embedment of the invention showing the assembly being pulled up with one tool already being removed and the second tool near the bottom of the assembly about to be removed with a second ball.

It is to be understood that FIGS. 1 through 3 are for illustration and not to scale with invention 10 relative to well 20, spacing and or configuration of frac plug(s) 60, well 20 dimensions, and so forth. A person having ordinary skill in the art would understand the figures relative to and regarding invention 10.

Again referring to the illustrations in general and more in particular to FIG. 1, the current invention 10 contemplates drilling the control plug 40 and the frac plug(s) 60 obstructions out, by running assembly 65 into well 20 wherein assembly 65 may include but is not limited to a first profile nipple 130, drill and or work string tubing 85, a cross over profile nipple 90 with an associated first back pressure valve tool 70, herein after referred to as first tool 70, production tubing 100, a second profile nipple 135 that may allow for a wireline plug to be set if tubing has to pulled, production tubing 105, a profile nipple 110 with a second back pressure valve tool 75, herein after referred to as second tool 75, a joint of production pipe 120, a third no go profile nipple 125 that may have a smaller inner diameter that does not allow tool 75 or any other wireline plug to pass, a wireline re-entry guide (not depicted), a pump off bit sub 140 also referred to as ball drop bit sub 140, a bit 150 and combinations thereof.

It is understood that production tubing, pipe, and or pipe string 100 and 120 may be a joint, several joints, and so forth with a preferred embodiment of being a single joint for pipe 100 and or pipe string 120. It is also understood the numerous combinations and arrangements for assembly 65 are contemplated.

Therefore, invention 10 may include from bottom 30 of well 20 and assembly 65 comprising:

1. bit 150;
2. pump off bit sub 140;
3. wireline re-entry guide (not depicted);
4. third no go profile nipple 125;
5. at least one joint of tubing also referred to as production pipe 120;
6. profile nipple 110 with a locked in place second tool 75;
7. desired production tubing 105;
8. second profile nipple 135;
9. desired production tubing 100;
10. cross over back pressure valve profile nipple 90 with tested tool 70 locked in profile at the junction of the work string 85 and production tubing 100 that may provide a double barrier in the event of failure of lower back pressure valve;
11. first profile nipple 130, which may allow for plug to be set if failure of all back pressure valves; and
12. remaining work string 80 up to the surface.

Once again referring to the illustrations in general and more in particular to FIG. 2, after the drilling out process is complete, instead of removing assembly 65 from well 20, a first ball 160 is pumped down well 20 the work string 80 and into assembly 65 where it may seat in the ball drop bit sub 140 releasing drilling bit 150 at well 20 bottom 30. It is understood that first ball 160 is a smaller diameter ball known in the art.

Now referring again to the illustrations and more in particular to FIG. 3, the work string 85 may be pulled from well 20 and the first tool 70 and profile nipple 90 are removed at the surface. Invention 10 allows the work string 85 to be pulled from well 20 under high pressure. Work string 85 may now be hung off in the wellhead and a production tree may now be installed. A second and or large ball 170 is then pumped down the production tubing 100 to seat in the remaining second tool 75.

Figure 4:
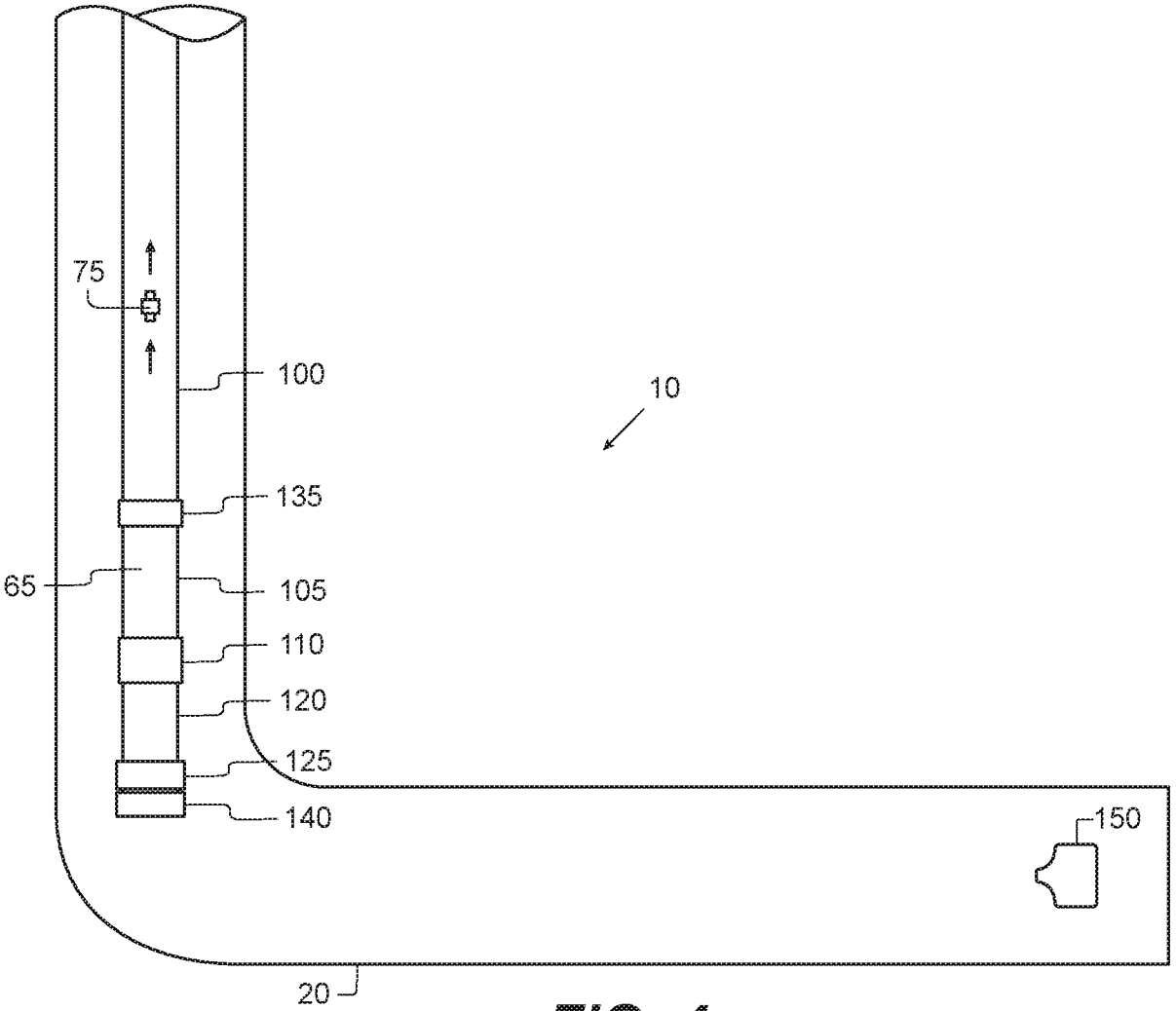
FIG. 4 is a general illustration in accordance with a preferred embedment of the invention showing the remaining tool being released and coming up to the surface to be removed and the well ready for production.

Still again referring to the illustrations in general and more in particular to FIG. 4, the pump pressure releases in second tool 75, which may flow to a lubricator mounted on the production tree. The pressure is bled off the catcher and the catcher and tool 75 may be removed. Well 20 is now ready for operations.

It is therefore understood in accordance with a preferred embodiment, invention 10 may allow well 20 to be drilled using stick tubing with bit 150 that is connected to a pump off drill bit sub 140. It is contemplated that of the items listed above, 1 through 9 are run in the well 20 to the desired depth that will allow the weight of the pipe string 80 to remain "pipe heavy" during drill out and hang off of production tubing in general. Hybrid profile nipple 90 with tool 70 is then placed in the crossover from production tubing 100 to the work string 85 of tubing. All of the frac plug(s) 60 and control plug 40 are then drilled out to the plug back total depth and or length of the well 20.

After the frac plug(s) 60 have been drilled and adequate circulation to clean well 20 bore, ball 160 may be dropped and may pass through all tubing and both first tool 70 and second tool 75 and seat in the pump off bit sub 140. It is contemplated to utilize a ⅞"(2⅞) or 9/16"(2⅜) diameter ball 160 although it is understood that numerous other diameters may be utilized.

As stated above, adequate pressure is applied and the bit 150 and pump off sub 140 are pumped off and left at the bottom and or end 30 of the well 20 so that it will not cause obstruction to the flow of hydrocarbons from well 20. The pipe string 80 is then pulled from the well 20 to the point of the hybrid cross over profile nipple 90 with first tool 70. The pressure may then be bled off of the back pressure valve at the hybrid cross over profile nipple 90 with first tool 70 from the working string 85 to production. This will ensure that the bottom back pressure valve and or tool 75 is competent and the top back pressure valve and or tool 70 can be removed.

Production tubing 100 will then be placed to the desired depth. A tubing hanger w/ back pressure valve will be installed at the surface and will be stripped down through BOP stack to tubing head and locked in place. It is contemplated to now bleed off surface and equipment as well as monitor. If well 20 is secure, the surface equipment is then rigged down and well head installed. At this point the production tubing string design may be:

1. pump off bit sub 140;
2. wireline guide (not depicted)
3. third no go profile nipple 125
4. one joint of production pipe 120
5. profile nipple 110 with a hybrid second tool 75;
6. production tubing 100
7. second profile nipple 135, which may allow for wireline plug to be set if tubing needs to pulled from well 20; and
8. desired production tubing 100 to surface.

Back Pressure Valve Tool

Figure 5:
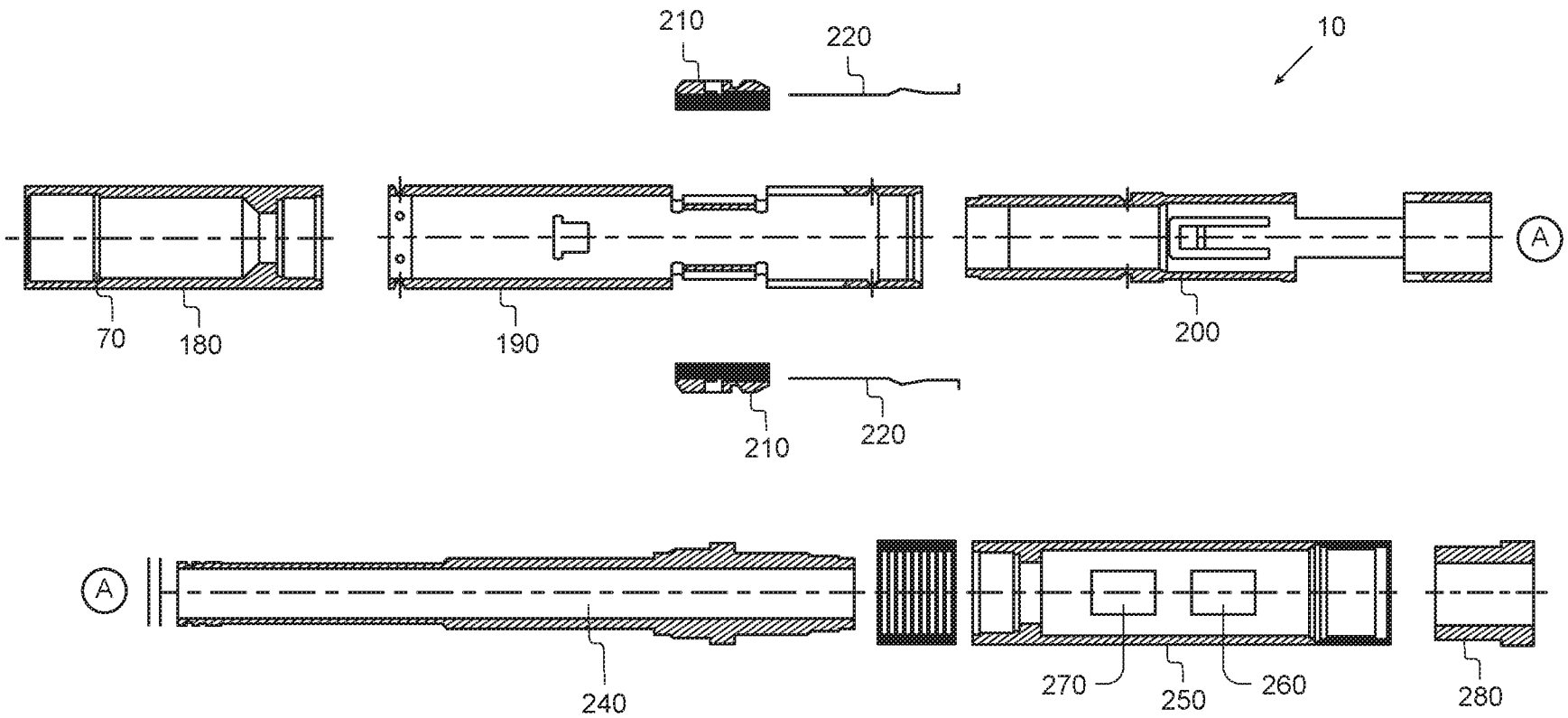
FIG. 5 is a general illustration in accordance with a preferred embedment of the invention depicting a tool in a partially exploded and cut away view.

Once again referring to the illustrations in general and more in particular to FIG. 5, in accordance with a preferred embodiment, first tool 70 and second tool 75 hereinafter collectively referred to as tool 70 in that it is understood that first tool 70 and second tool 75 are the same design. Tool 70 generally functions as a cross between a pump through plug and a plunger tool as known in the art. As discussed further below, tool 70 allows for selectively securing in a third no go profile nipple 125 in general, allowing fluid to flow in one direction down well 20 through tool 70, and prevent fluid from flowing up well 20. Although back pressure valves utilized in horizontal well completion are known in the prior art, all the prior art devices require a physical line run down to the position to remove the valve whereas invention 10 does not require any line use but rather relies on a dropped ball system. First tool 70 and or second tool 75 may have a first end, a second end and a passageway there through as generally depicted. It is also to be understood that FIGS. 5 through 11 are generally oriented wherein the left of the illustration would be the top and or first end and the right would be the bottom and or second end. It is also understood that a passageway is defined between. This is in reference to the top being up well and the bottom being down well.

It is understood that a profile nipple, such as profile nipples 90 and 110, are typically a short piece of pipe and may be threaded at both ends with male threads. They are typically a completion component fabricated as a short section of heavy wall tubular with a machined internal surface that provides a seal area and a locking profile.

Tool 70 may include a fish neck 180 capable of receiving second ball 170, but also allow first ball 160 to pass there through. As understood, fish neck 180 is typically a region with a reduced diameter at or near the upper end of a drill string member, which fishing tools can grab. Invention 10 does contemplate possible utilization of fishing tools if needed during a failure although fish neck 180 is intended to be used to receive second ball 170 and not to be utilized with a wire line unless necessary. Fish neck 180 generally attaches to shearing assembly 190.

First tool 70 and or second tool 75 may include a releasable positioning mechanism for positioning and generally adapted to release from a drill string profile nipple when a ball is dropped down into the tool as will be described in greater detail below. Shearing assembly 190 may be in communication with internal sleeve also known as sliding sleeve 200 that may enter shearing assembly when down hole pressure 50 generally accumulates after second ball 170 is dropped and generally blocks passage of the fluid. Sliding sleeve 200 may utilize locking keys 210 which may be spring loaded by spring 220 as known in the art. Locking keys 210 generally secure tool 70 inside profile nipples 90 and or 110 until second ball 170 drops and slides sliding sleeve 200 into shearing assembly 190.

Shearing assembly 190 of invention 10 generally includes a shearing system for tool 70 when removal is desired. It is generally activated by releasing second ball 170 from the surface, which will seat in the tool 70 creating a seal that can be pressurized to release the tool 70 from profile nipples 90 and or 110. Tool 70 is generally designed to lock out once released thereby preventing the tool 70 from hanging up or reengaging as it is being removed up well 20. It may be a Bowen Connection lubricator but is not limited to same. Second ball 170 may be but is not limited to a 1¼" ball dropped from the surface and pumped down. It may seat in the fish neck 180 of the tool 70. Sufficient pressure 50 from well 20 fluids traveling up well 20 is generally applied to shear the shear pins 230.

Invention 10 shear pins 230 are broken when sliding sleeve 200 is forced into shearing assembly 190 contacting shearing pins 230. Invention 10 may utilize six shear pins 230 located on tool 70 that may go to a recess in sliding sleeve 200. The desired number of shearing pins 230 can be altered to more and or less removed to allow for proper shearing pressure. By example some wells may have a higher pressure and other lower. It may be desirable to adjust the number of shear pins 230 to accommodate the well pressure such that a lower pressure may utilize less shear pins 230 and a higher pressure may utilize a higher number of pins and so forth. This process will allow the locking keys 210 to retract and unlock from profile nipples 90 and or 110 allowing tool 70 to come up well 20.

Tool 70 may also include an inner mandrel 240 in communication with sliding sleeve 200 and flapper body assembly 250 with at least one flapper or flapper valve 260 and or second flapper or flapper valve 270. It is understood that numerous configurations of flappers are contemplated as known in the art. Flapper body assembly 250 is a one-way flapper system that allows fluid to travel down well 20 through tool 70 but not up well 20. Flapper body assembly 250 is a back pressure valve that prevents back pressure from coming up tool 70 and or well 20. It is understood that once tool 70 is removed, pressure and or fluid may then be produced up well 20 as desired. Flapper body assembly 250 may include cap 280. It is understood that at least one flapper valve 260 and or 270 is positioned in first tool 70 and or second tool 75 passageway and adapted to allow fluid 290 to flow downhole of horizontal well 20 through first tool 70 and or second tool 75 passageway and prevent fluid 290 from traveling up horizontal well 20 through first tool 70 and or second tool 75 passageway.

Figure 6:
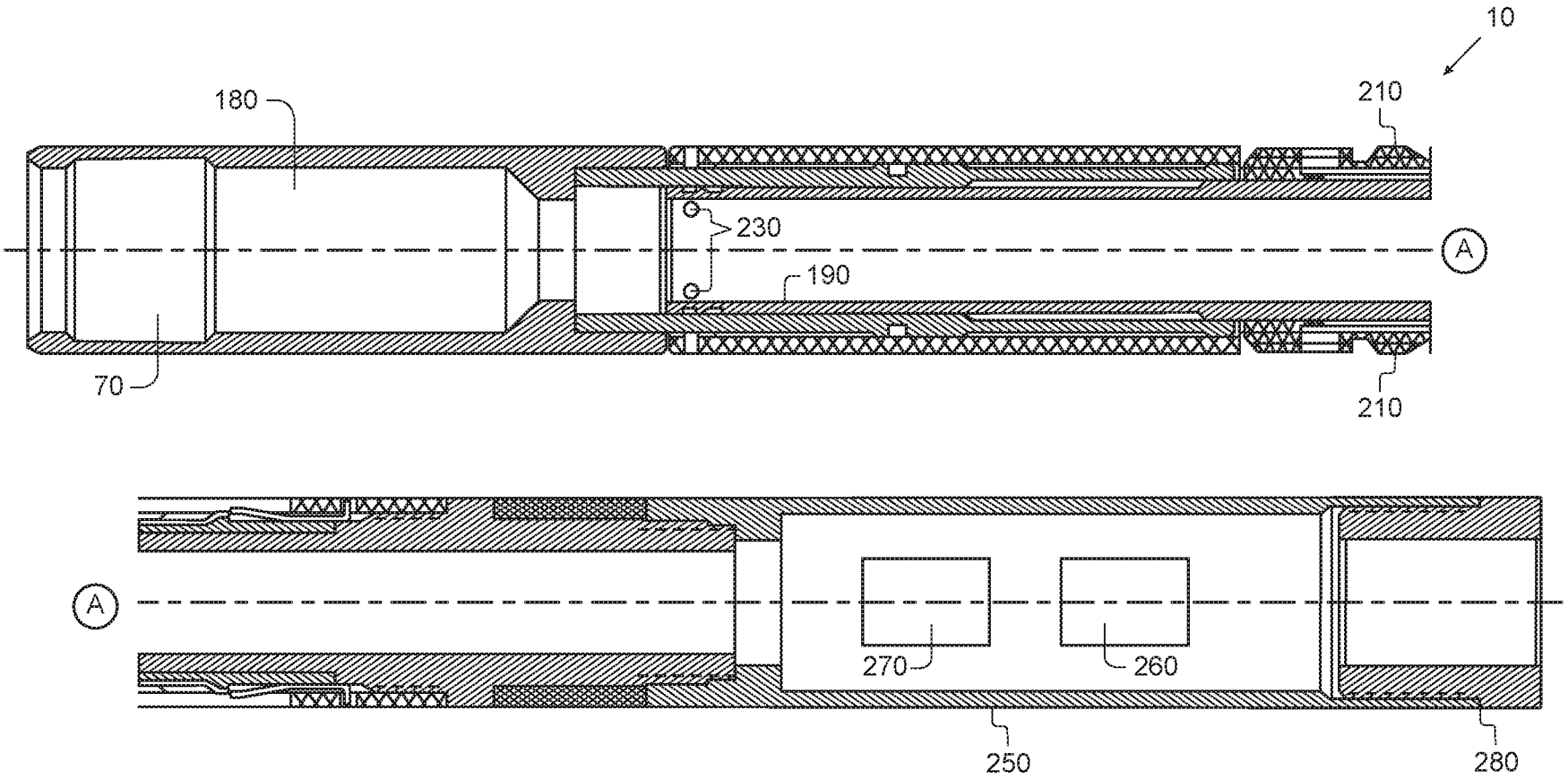
FIG. 6 is a general illustration in accordance with a preferred embedment of the invention depicting the tool from FIG. 5 assembled.

Referring to the illustrations again and more specifically to FIG. 6, tool 70 is generally depicted wherein sliding sleeve 200 has engaged and sheared pins 230. At this point the locking keys 210 are locked in the retracted position. After locking keys 210 are unlocked, the pressure of the well 20 will lift tool 70 to the surface where it may lock into the GS Spear with the fish neck 180 inside the lubricator. Well 20 may then be shut in and the well head is relieved of pressure allowing for removal of lubricator and tool 70.

Well 20 is now ready for production. After the wellhead is placed on at the surface and tested, a two way check back pressure valve is removed from the tubing hanger and a tool lubricator is placed on the well head.

Tool 70 may be sizes 2⅞ 6.5 #EUE that may lock into a X-profile Nipple (1"I.D.); 2⅞ 7.9 #PH6 that will lock into Crossover R-profile Nipple or R-profile Nipple (1" I.D.); 2⅜ 4.7 #EUE that will lock into a X-profile Nipple (⅝" I.D.); 2⅜ 5.95 #PH6 that will lock into a Crossover R-profile nipple or R-profile nipple (⅝" I.D.) It is understood that tool first tool 70 and or second tool 75 may be utilized with a profile nipple that may accommodate any other wireline set plug if necessary.

Referring now to the illustrations and more in particular to FIGS. 7, 8, 9 and 10, fluid 290 is generally depicted with arrows indicating fluid direction. First tool 70 and or second tool 75 allow fluid 290 to pass down into well 20 as desired but not up well 20.

Figure 7:
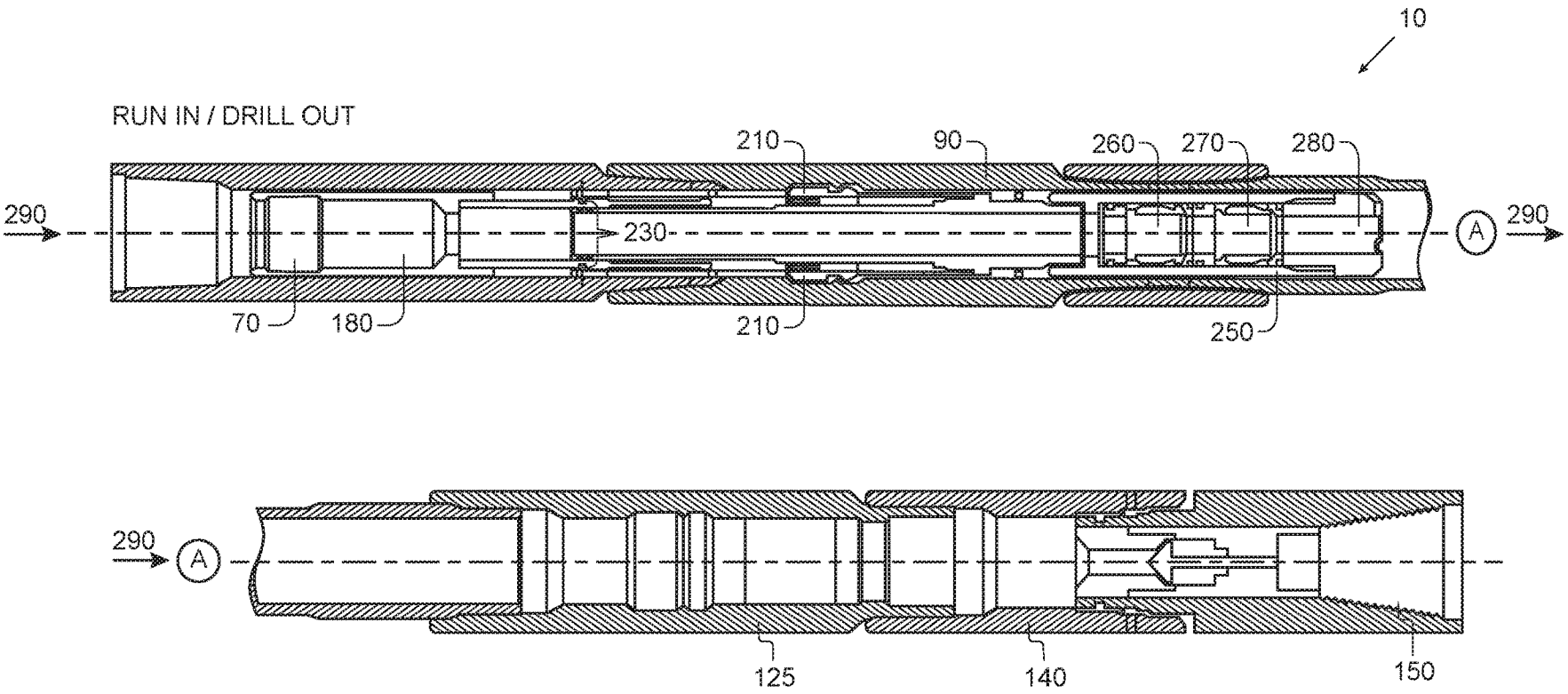
FIG. 7 is a general illustration in accordance with a preferred embedment of the invention depicting the assembly during the run in and drill out step and a toll in a profile nipple.

FIG. 7 is an illustration of the "run in/drill out" as generally depicted in FIG. 1. Fluid 290 passes through first tool 70 and or second tool 75 to operate drill bit 150. First tool 70 and or second tool 75 are locked into the profile nipples 90 and or 110 and flapper 260 and or second flapper 270 are open. Fluid 290 travels down well 20 for removing control plug 40 and or frac plug(s) 60.

Figure 8:
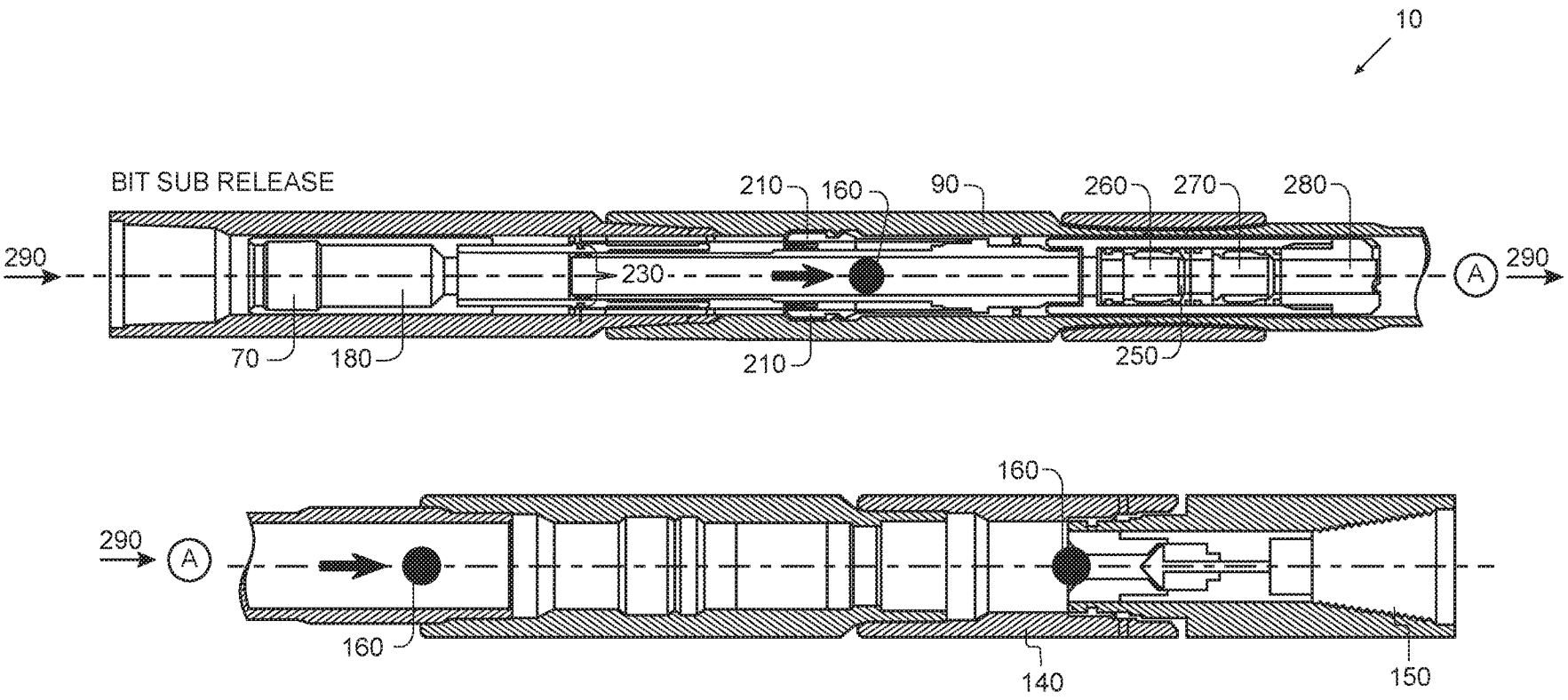
FIG. 8 is a general illustration in accordance with a preferred embedment of the invention depicting the assembly during the release of the drill bit also known as the bit sub release step and a toll in a profile nipple . . . .

FIG. 8 is an illustration of the "bit sub release" generally depicted in FIG. 2. First ball 160 is generally depicted as it travels and seats to release drill bit 150 after drilling is completed. Fluid 290 is still traveling down well 20 to allow first ball 160 to travel. First tool 70 and or second tool 75 are locked into the profile nipples 90 and or 110 and flapper 260 and or second flapper 270 are open.

Figure 9:
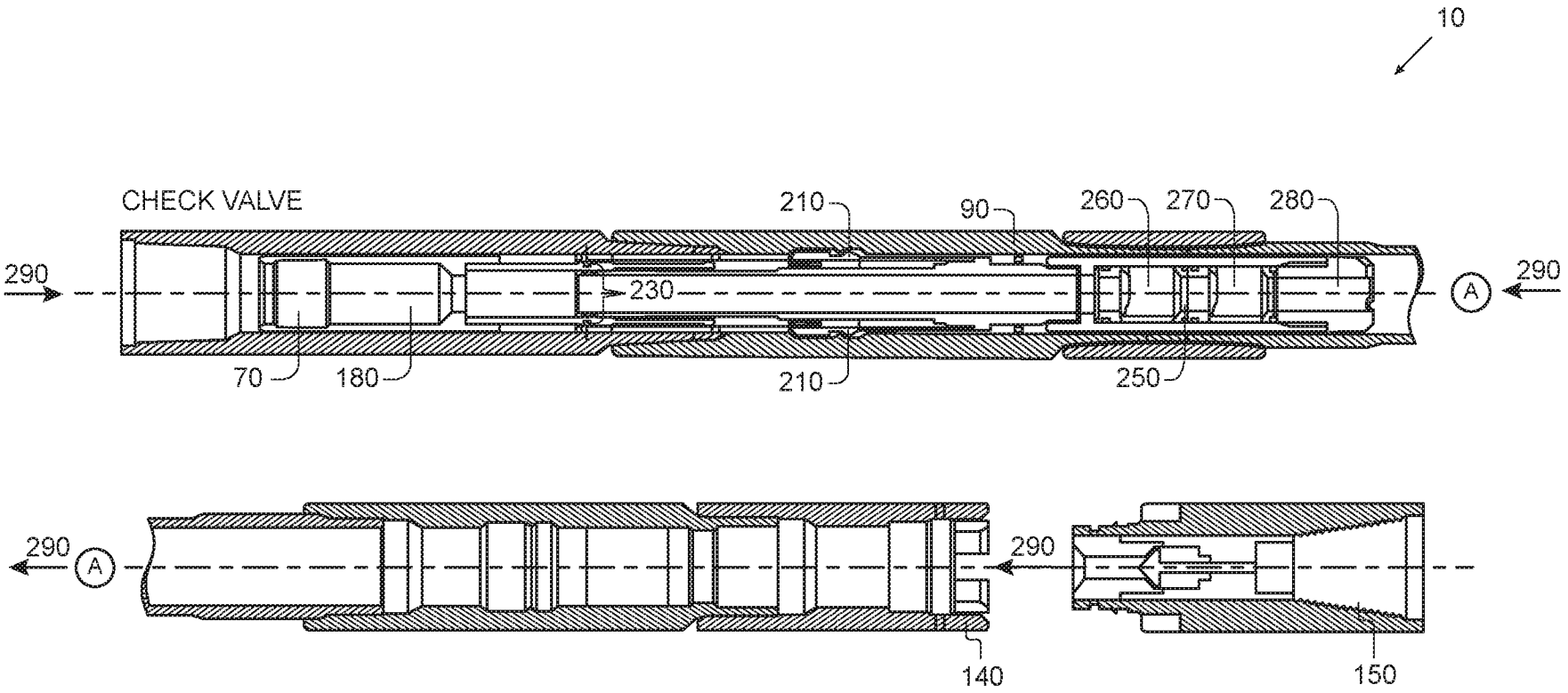
FIG. 9 is a general illustration in accordance with a preferred embedment of the invention depicting the assembly where the tool is moving along with the assembly up well, the flappers are closed blocking fluid from coming up well as a check valve and a toll in a profile nipple.

FIG. 9 is an illustration of the "check valve" generally depicted in FIG. 3 before the second ball 170 is dropped. Pressure is essentially decreased up well 20 allowing pressure below to push the assembly 65 up. Flappers 260 and or 270 are closed as the pressure above first tool 70 and or second tool 75 is less than the pressure below first tool 70 and or second tool 75 preventing fluid from traveling through first tool 70 and or second tool 75. Fluid 290 is generally moving up well 20.

Figure 10:
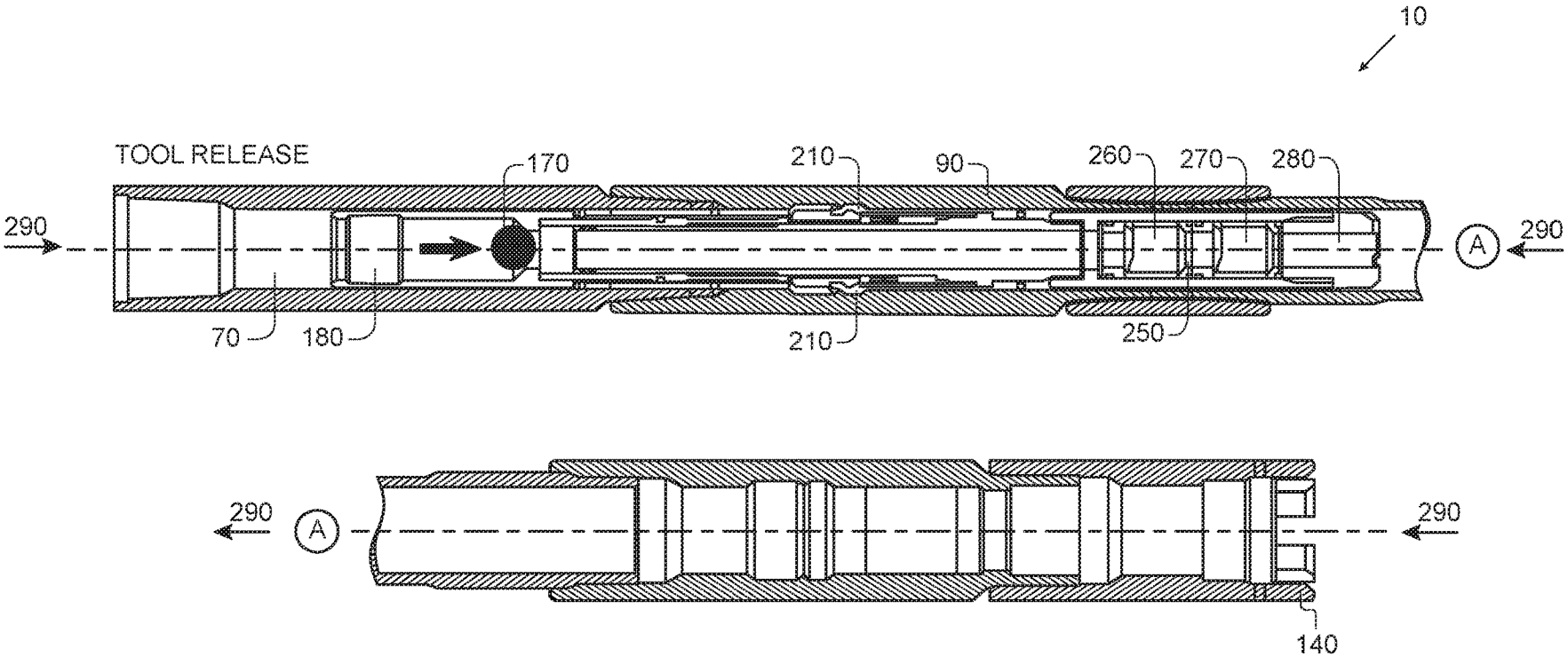
FIG. 10 is a general illustration in accordance with a preferred embedment of the invention depicting the assembly where the tool is about to be released by a ball and move up and out of the profile nipple.

FIG. 10 is an illustration of the "tool release" generally depicted in FIG. 3 after the second ball 170 is released and FIG. 4 where tool first tool 70 and or second tool 75 are released from nipple profiles 90 and or 110. Shear pins 230 have been broken and locking keys 210 have disengaged from profile nipples 90 and or 110. Fluid 290 is generally moving up well 20. Flappers 260 and or 270 are closed preventing fluid 290 from traveling through first tool 70 and or second tool 75.

Figure 11:
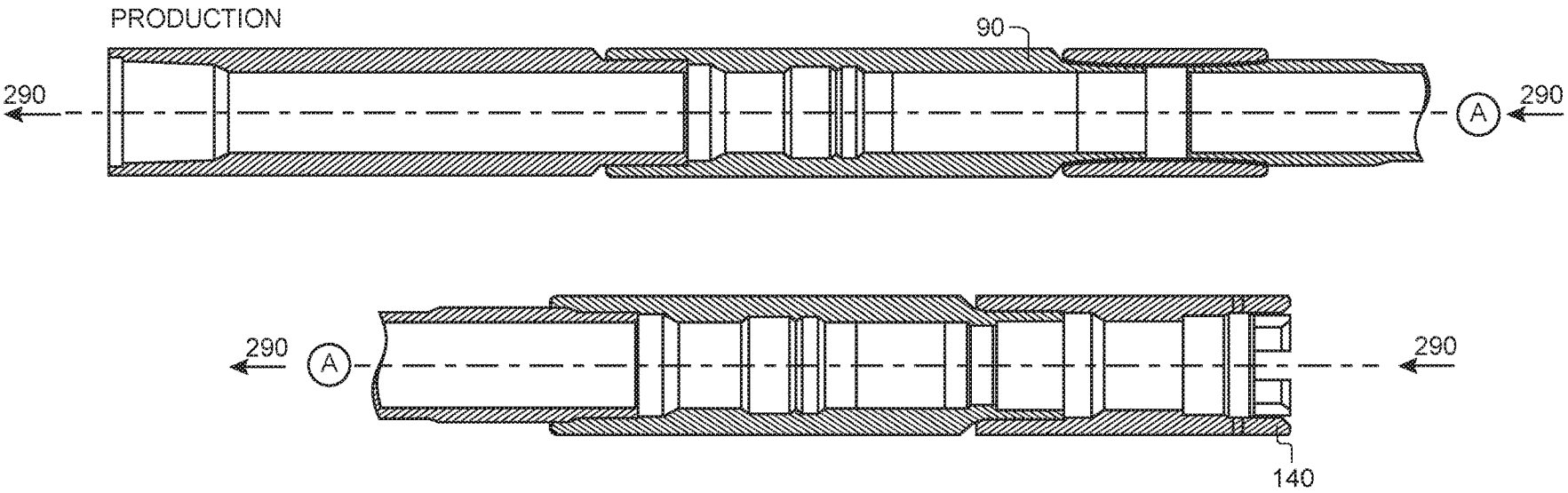
FIG. 11 is a general illustration in accordance with a preferred embedment of the invention depicting the assembly where the tool is out and the well is ready for production with fluid traveling up the assembly.

FIG. 11 is an illustration of "production" generally depicted in FIG. 4 as the first tool 70 and second tool 75 is moved up well 20 and is now removed from nipple profiles 90 and or 110. Fluid 290 is now permitted to flow through and up well 20. First tool 70 and or second tool 75 may be removed from well 20 with lubricator.

Invention 10 therefore contemplates providing a retrievable back pressure valve for use with a horizontal well completion operations during drilling out plug procedures comprising a tool with a first end, a second end and a passageway there through wherein said tool is adapted to be removably positioned in a drill string profile nipple in said horizontal well; at least one flapper valve positioned in said tool said passageway adapted to allow fluid to flow downhole of said horizontal well through said tool said passageway and prevent said fluid from traveling up said horizontal well through said tool said passageway; and a releasable positioning mechanism attached to said tool for positioning said tool in said drill string profile nipple and adapted to release said tool from said drill string profile nipple when a ball is dropped down said horizontal well and enters said tool.

Changes may be made in the combinations, operations, and arrangements of the various parts and elements described herein without departing from the spirit and scope of the invention. Furthermore, names, titles, headings and general division of the aforementioned are provided for convenience and should, therefore, not be considered limiting.

We claim:

1. A retrievable back pressure valve for use with a horizontal well completion operations during drilling out plug procedures comprising:

a tool with a first end, a second end and a passageway there through wherein said tool is adapted to be removably positioned in a drill string profile nipple in said horizontal well;

at least one flapper valve positioned in said tool said passageway adapted to allow fluid to flow downhole of said horizontal well through said tool said passageway and prevent said fluid from traveling up said horizontal well through said tool said passageway; and a releasable positioning mechanism attached to said tool for positioning said tool in said drill string profile nipple and adapted to release said tool from said drill string profile nipple when a ball is dropped down said horizontal well and enters said tool and wherein said releasable positioning mechanism has six shear pins.

* * * * *